US010751603B1

(12) United States Patent
Tseng

(10) Patent No.: US 10,751,603 B1
(45) Date of Patent: Aug. 25, 2020

(54) SHUFFLING MACHINE HAVING CARD DISPENSING STRUCTURE

(71) Applicant: Bingotimes Digital Technology Co., Ltd., Taichung (TW)

(72) Inventor: Kuo-Lung Tseng, Taichung (TW)

(73) Assignee: BINGOTIMES DIGITAL TECHNOLOGY CO., LTD., Taichung (TW)

( * ) Notice: Subject to any disclaimer, the term of this patent is extended or adjusted under 35 U.S.C. 154(b) by 0 days.

(21) Appl. No.: 16/572,601

(22) Filed: Sep. 17, 2019

(51) Int. Cl.
*A63F 1/12* (2006.01)
*A63F 1/14* (2006.01)
*A63F 11/00* (2006.01)

(52) U.S. Cl.
CPC ..... *A63F 1/12* (2013.01); *A63F 1/14* (2013.01); *A63F 11/0002* (2013.01)

(58) Field of Classification Search
CPC ..... A63F 1/12; A63F 1/14; A63F 11/0002
USPC ..... 273/149 R, 149 P; 463/22
See application file for complete search history.

(56) References Cited

U.S. PATENT DOCUMENTS 2,159,958 A * 5/1939 Sachs ..... A63F 1/12 273/149 R
5,000,453 A * 3/1991 Stevens ..... A63F 1/12 273/149 R
5,692,748 A * 12/1997 Frisco ..... A63F 1/12 273/149 R
5,695,189 A * 12/1997 Breeding ..... A63F 1/12 273/149 R
5,718,427 A * 2/1998 Cranford ..... A63F 1/12 273/149 R
6,189,880 B1 * 2/2001 Besold ..... B65H 39/042 270/58.25
2005/0140090 A1 * 6/2005 Breeding ..... A63F 1/12 273/149 R
2008/0284096 A1 * 11/2008 Toyama ..... A63F 1/12 273/149 R
2009/0072477 A1 * 3/2009 Tseng ..... A63F 1/12 273/149 R
2009/0314188 A1 * 12/2009 Toyama ..... A63F 1/12 108/50.11
2014/0353913 A1 * 12/2014 Shigeta ..... A63F 1/12 273/149 R

* cited by examiner

*Primary Examiner* — Benjamin Layno
(74) *Attorney, Agent, or Firm* — Raymond Y. Chan; David and Raymond Patent Firm

(57) ABSTRACT

A shuffling machine having a card dispensing structure is provided. The shuffling machine has a central accommodating compartment, a left accommodating compartment, a right accommodating compartment, and a card dispensing space. A translation plate is disposed in the card dispensing space. A driving mechanism is connected to the translation plate. The translation plate is coupled with a card dispensing device configured to dispense the playing cards in the card dispensing space. The card dispensing device includes a fixed seat and a dispensing block. The fixed seat limits a vertical displacement of the dispensing block within a predetermined distance. Left and right sides of an underside of the dispensing block have beveled edges. Thereby, the dispensing block and its beveled edges can prevent the playing card that is mistakenly riffled from being bent and damaged.

3 Claims, 14 Drawing Sheets

SHUFFLING MACHINE HAVING CARD DISPENSING STRUCTURE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a shuffling machine having a card dispensing structure, and more particularly to a shuffling machine having a card dispensing device that can be lifted to avoid damage to playing cards.

Description of Related Arts

As shown in FIGS. 1-4, a conventional shuffling machine 10 has a central accommodating compartment 11, a left accommodating compartment 12, and a right accommodating compartment 13. A card dispensing space 14 is disposed above the central accommodating compartment 11, the left accommodating compartment 12 and the right accommodating compartment 13. Either side of the top end of the central accommodating compartment 11 is provided with a card guiding roller assembly 15. The central accommodating compartment 11 is provided with a central lifting platform 17 that can ascend and descend. A lifting platform 18 is disposed in each of the left accommodating compartment 12 and the right accommodating compartment 13. A translation plate 19 is moveably disposed at a predetermined height above the central accommodating compartment 11, the left accommodating compartment 12, and the right accommodating compartment 13. The translation plate 19 includes a card dispensing piece 20 extending downwardly. A driving mechanism 21 is connected to the translation plate 19 for driving the translation plate 19 to move back and forth in the left and right directions of the card dispensing space 14, so that the card dispensing piece 20 in the card dispensing space 14 can dispense playing cards 1 located in the central accommodating compartment 11 to the left accommodating compartment 12 or the right accommodating compartment 13 as the central lifting platform 17 is gradually lifted, thereby imitating a manual shuffle to achieve a riffle shuffle and an automatic shuffle. However, in the above-mentioned shuffling to machine 10, although the playing cards 1 can be automatically riffled and shuffled, it still has the following disadvantages:

1. When card dispensing piece 20 dispenses the playing cards 1 in the central accommodating compartment 11 to the left accommodating compartment 12 or the right accommodating compartment 13, because the playing cards 1 may be warped or arched after use, the playing cards 1 may be mistakenly riffled by the card dispensing piece 20 due to the warped or arched point. One end of the playing card 1 that is mistakenly riffled abuts against the edge of the card guiding roller assembly 15, and the other end is still forcibly moved by the dispensing piece 20, causing the playing card 1 to be deformed and damaged (as shown in FIG. 2).

2. When the stacked playing cards 1 are dispensed by the card dispensing piece 20, because the playing cards 1 are attached to one another, the riffled playing card 1 may absorb and bring the next playing card 1 toward the card guiding roller assembly 15 of the left accommodating compartment 12 or the right accommodating compartment 13. When the suction force is weakened halfway, the playing card 1 is dropped and stuck between the card dispensing piece 20 and the card guiding roller assembly 15 (as shown in FIG. 3). As a result, the shuffling machine 10 malfunctions to affect the fairness of the game.

When the above situation occurs, the obstacle needs to be removed manually. The shuffling machine 10 has a high failure rate, which affects the fairness, reduces the player's game interest, and causes unnecessary waste of the playing cards 1. Accordingly, the inventor of the present invention has devoted himself based on his many years of practical experiences to solve these problems.

SUMMARY OF THE PRESENT INVENTION

The primary object of the present invention is to solve the aforesaid problems and to provide a shuffling machine having a card dispensing structure. The shuffling machine is provided with a card dispensing device that can be vertically moved. The card dispensing device includes a fixed seat that is fixed to a translation plate and a dispensing block that is movably connected to the fixed seat. Left and right sides of an underside of the dispensing block have beveled edges. Thereby, the liftable dispensing block and its beveled edges can prevent the playing card that is mistakenly riffled from being bent and damaged.

In order to achieve the above objects, a shuffling machine having a card dispensing structure is provided. The shuffling machine has a central accommodating compartment, a left accommodating compartment and a right accommodating compartment for accommodating playing cards. A card dispensing space is disposed above the central accommodating compartment, the left accommodating compartment and the right accommodating compartment. Either side of a top end of the central accommodating compartment is provided with a card guiding roller assembly. A translation plate is moveably disposed in the card dispensing space. A driving mechanism is connected to the translation plate. The translation plate is coupled with a card dispensing device configured to dispense the playing cards in the card dispensing space. The card dispensing device includes a fixed seat that is fixed to the translation plate and a dispensing block that is movably connected to the fixed seat. The fixed seat has a reverse "U" shape and includes a front plate, a rear plate and a recessed portion between the front plate and the rear plate. An upper magnetic member is disposed on a top surface of the recessed portion. A top of the dispensing block is provided with a lower magnetic member corresponding to the upper magnetic member. The upper magnetic member and the lower magnetic member are arranged with their like poles to repel each other. The dispensing block is insertedly connected to the recessed portion of the fixed seat. The fixed seat is able to repel the dispensing block downward. The fixed seat limits a vertical displacement of the dispensing block within a predetermined distance. Left and right sides of an underside of the dispensing block have beveled edges.

In an embodiment of the present invention, the fixed seat is provided with at least two guide rollers that are coaxial and corresponds to each other radially. The dispensing block is provided with at least two vertical grooves corresponding in position to the guide rollers so that the dispensing block is assembled to the fixed seat with the vertical grooves to lean against the guide rollers.

In an embodiment of the present invention, a screw hole is defined in each of the front plate and the rear plate. The guide rollers are connected to respective sides of the front plate and the rear plate. A top of the fixed seat is formed with a coupling groove for connecting the translation plate. Front and rear sides of the dispensing block are formed with vertical slots corresponding to the screw holes of the front plate and the rear plate. Two screws are inserted through the screw holes and engaged in the slots.

In an embodiment of the present invention, the top of the fixed seat is formed with holes. The dispensing block is formed with two perforations. Two fiber optic sensors pass through the fixed seat and are inserted through the holes of the top of the fixed seat to be connected to the perforations. The driving mechanism includes a left sensor, a fixed-point sensor, and a right sensor. A rear end of the translation plate is provided with a left sensing terminal, a right sensing terminal, a left sensing member, and a right sensing member. A distance between the left sensing terminal and the right sensing terminal is greater than a distance between the left sensing member and the right sensing member. The driving mechanism can drive the card dispensing device to move leftward for dispensing the playing cards so that the fixed-point sensor is to sense the right sensing terminal and the driving mechanism can drive the card dispensing device to move rightward for dispensing the playing cards so that the fixed-point sensor is to sense the left sensing terminal, and the card dispensing device is moved to be above the corresponding the card guiding roller assembly, this is defined as a first displacement stroke. Each of the fiber optic sensors can detect whether there is any one of the playing cards between the card guiding roller assembly and the dispensing block, and the card guiding roller assembly can rotate clockwise and counterclockwise; the driving mechanism further drives the translation plate to move rightward or leftward to dispense the playing cards, the left sensor can sense the left sensing member, the right sensor can sense the right sensing member, and the playing cards are dispensed to the left accommodating compartment or the right accommodating compartment, this is defined as a second displacement stroke.

Thereby, if the corner of the playing card is warped or arched by the dispensing block mistakenly, the beveled edge of the dispensing block allows the dispensing block to rise from the edge of the playing card to dispense the playing card smoothly, thereby avoiding the playing card from being deformed and damaged. When the translation plate is in the first displacement stroke, if the playing card that is erroneously attracted is stuck between the dispensing block and the card guiding roller assembly, the fiber optic sensor senses and rotates the card guiding roller assembly in the reverse direction, and the playing card is returned to the central accommodating compartment to remove obstacles, thereby preventing the game from being unfair.

DETAILED DESCRIPTION OF THE PREFERRED EMBODIMENT

Figure 1:
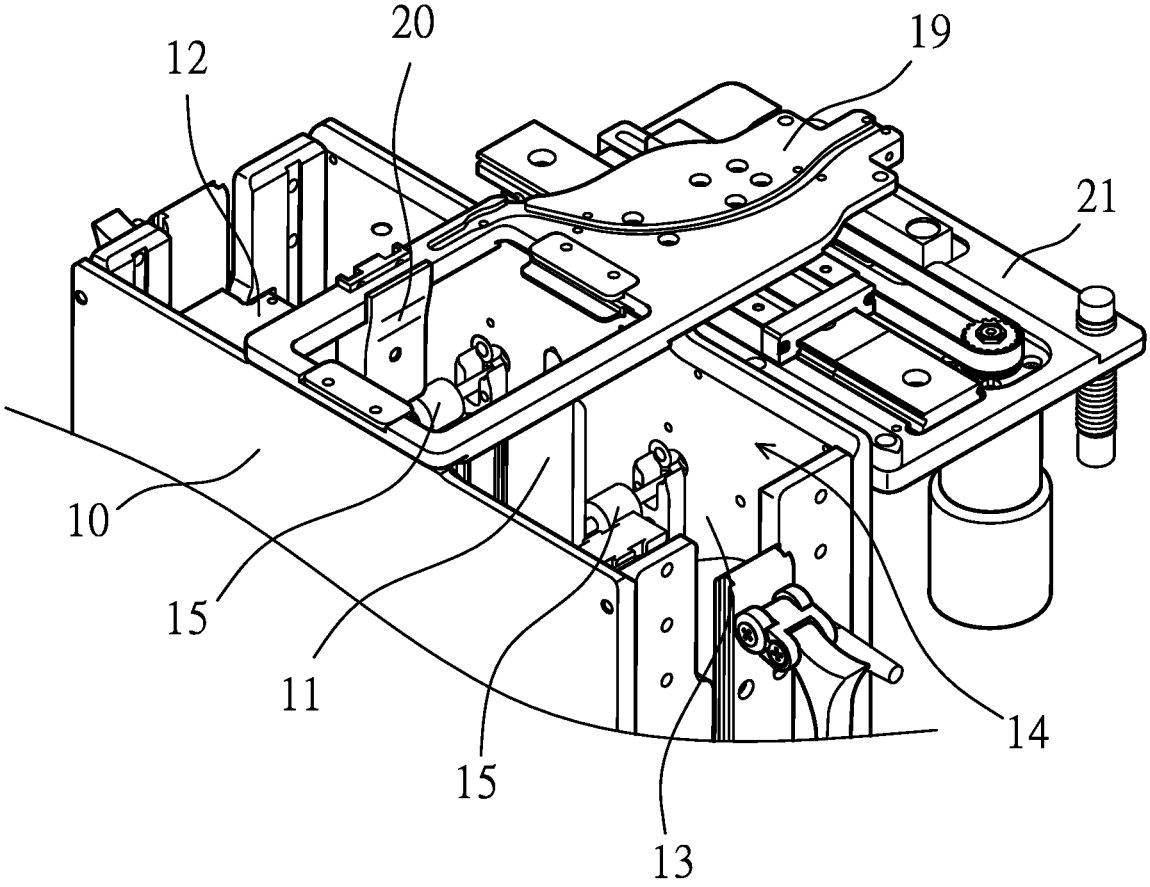
PRIOR ART FIG.1
FIG. 1 is a perspective view of a conventional shuffling machine.
Figure 2:
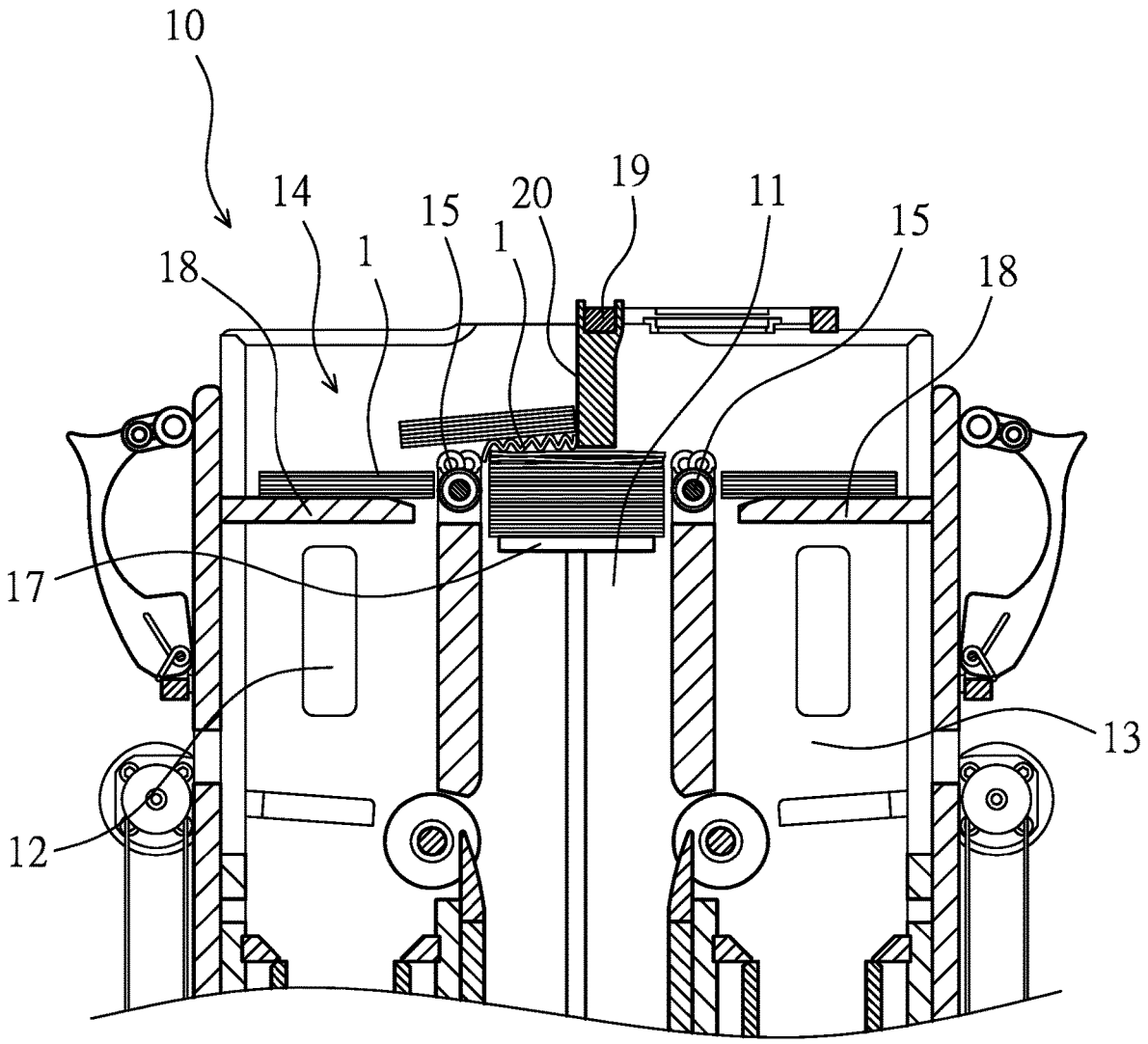
PRIOR ART FIG.2
FIG. 2 is a front cross-sectional view of the conventional shuffling machine, showing that one playing card is bent and deformed by riffling mistakenly.
Figure 3:
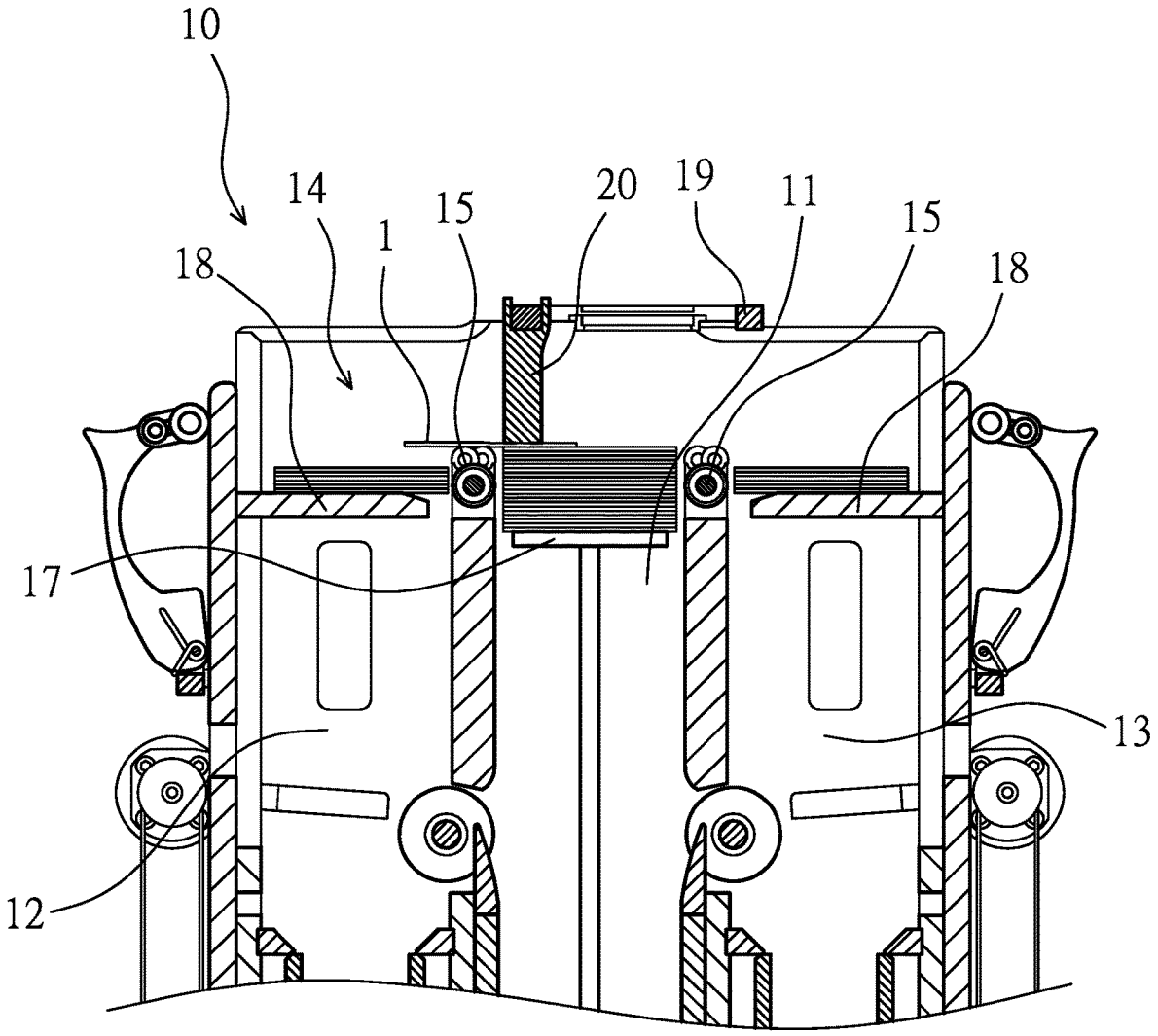
PRIOR ART FIG.3
FIG. 3 is a front cross-sectional view of the conventional shuffling machine, showing that one playing card is stuck between the card dispensing piece and the card guiding roller assembly.
Figure 4:
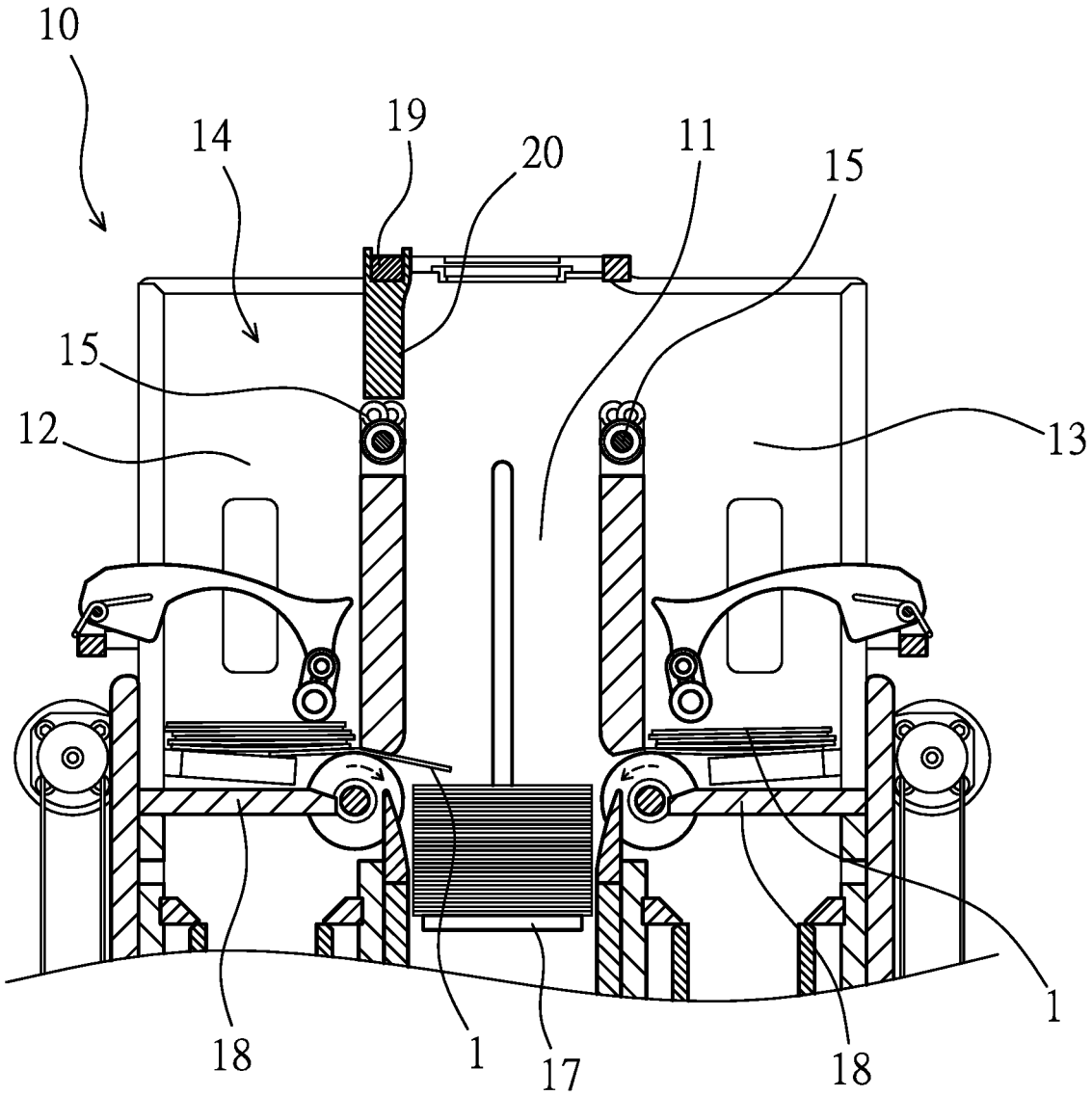
PRIOR ART FIG.4
FIG. 4 is a front cross-sectional view of the conventional shuffling machine, showing that the press arm loses its elastic force and fails to press against the playing cards.
Figure 5:
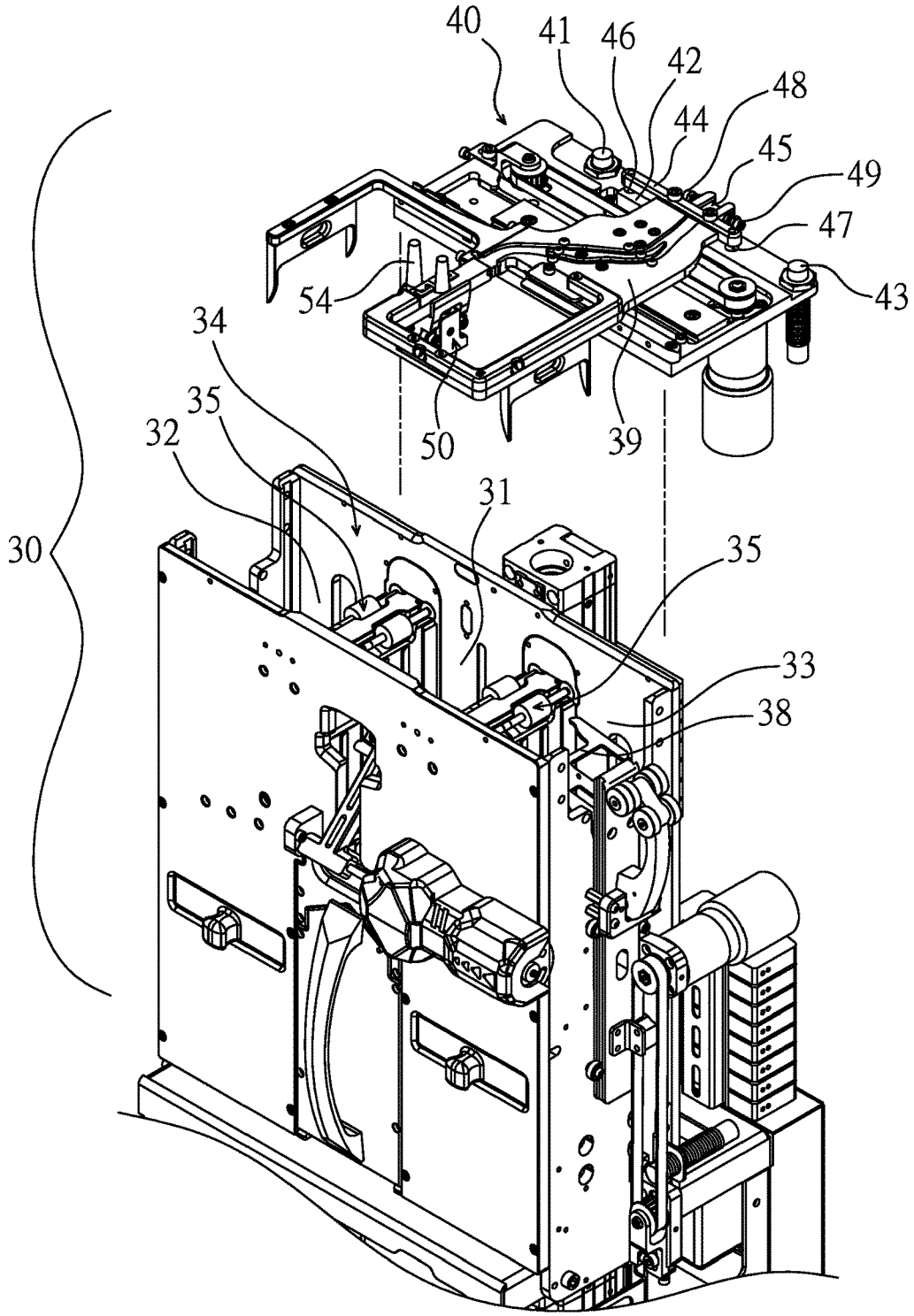
FIG. 5 is a perspective view of the translation plate, the driving mechanism and the card dispensing device of the present invention.
Figure 6:
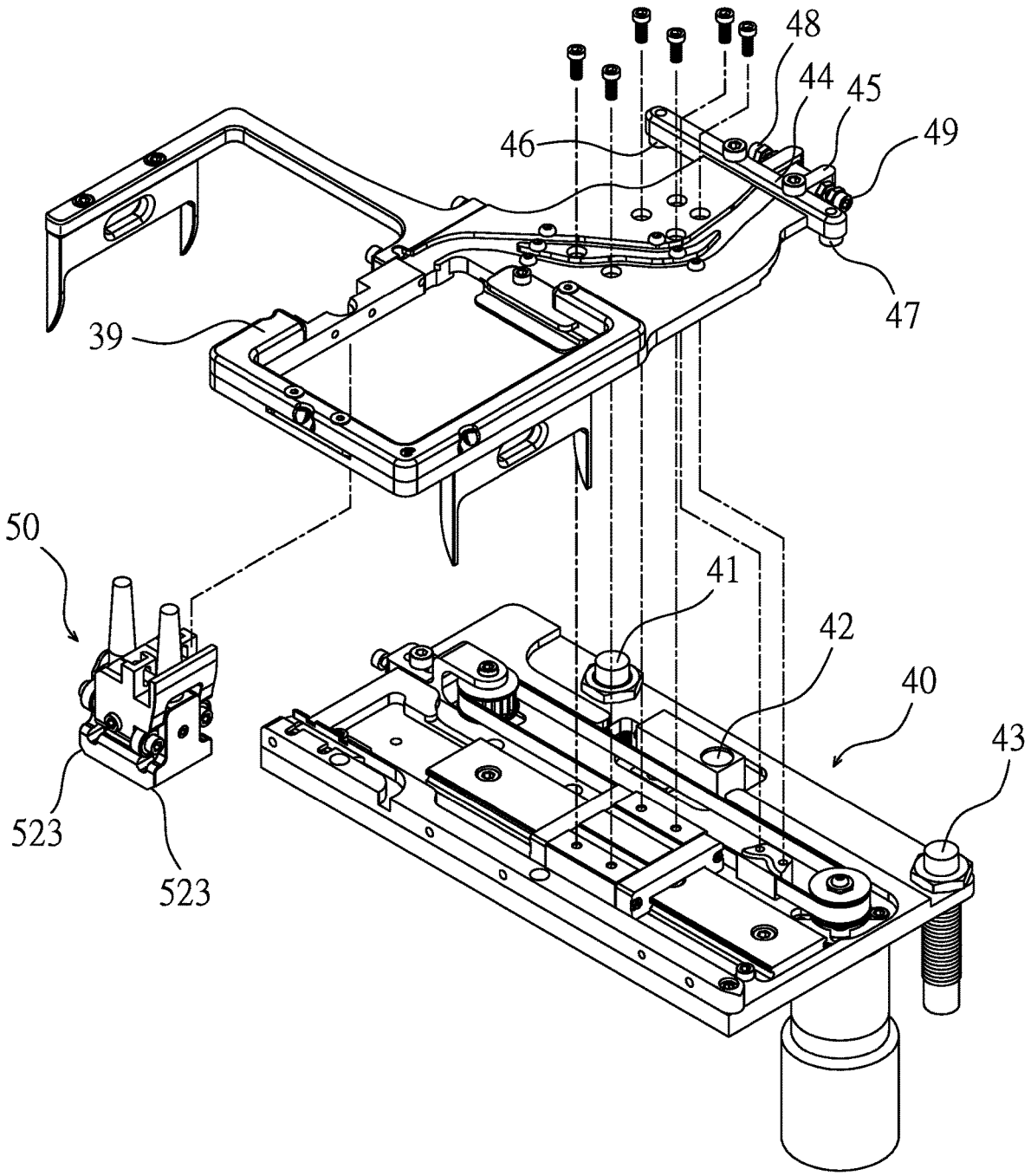
FIG. 6 is an exploded view of the translation plate, the driving mechanism and the card dispensing device of the present invention.
Figure 7:
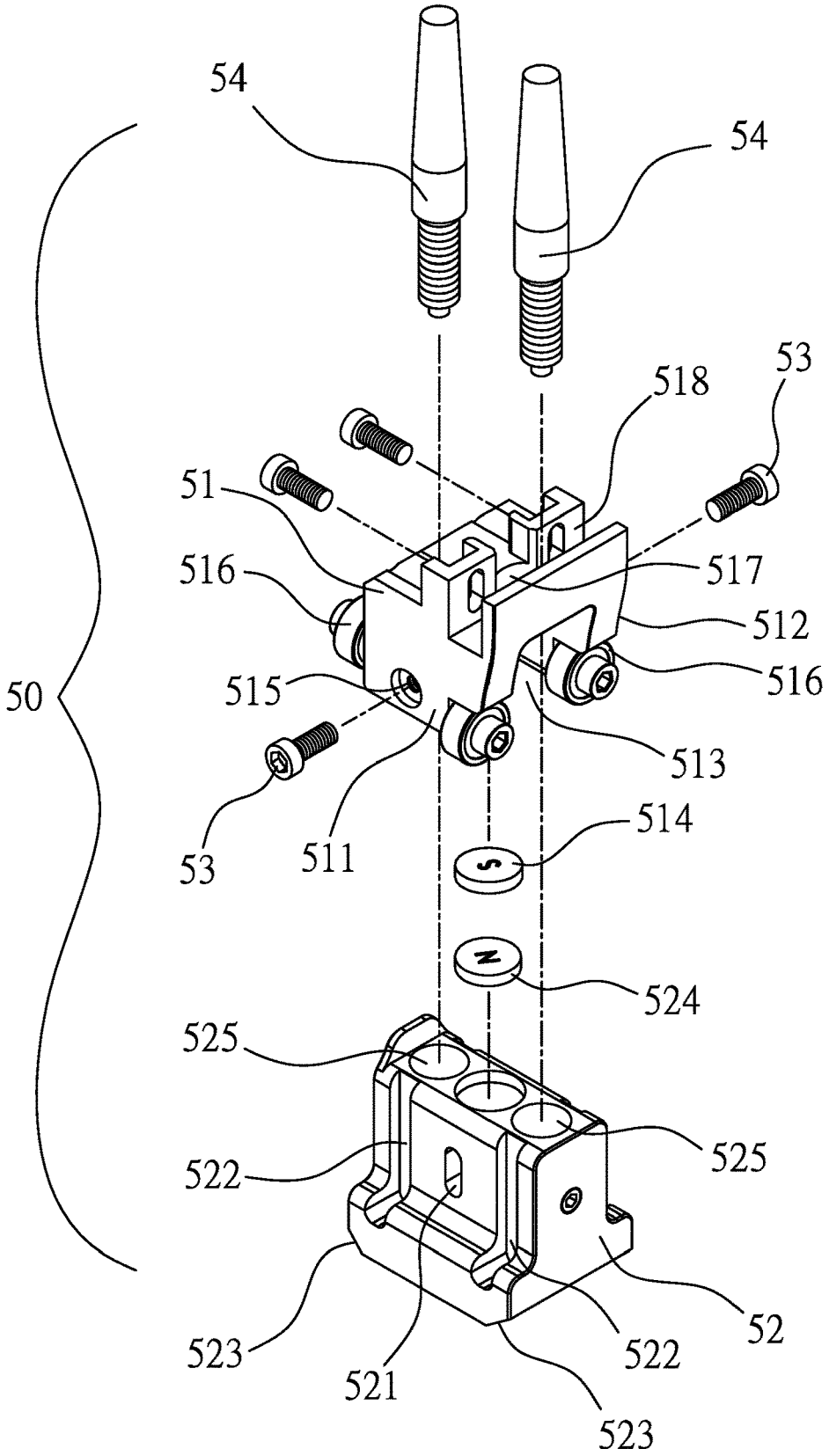
FIG. 7 is an exploded view of the card dispensing device of the present invention.
Figure 8:
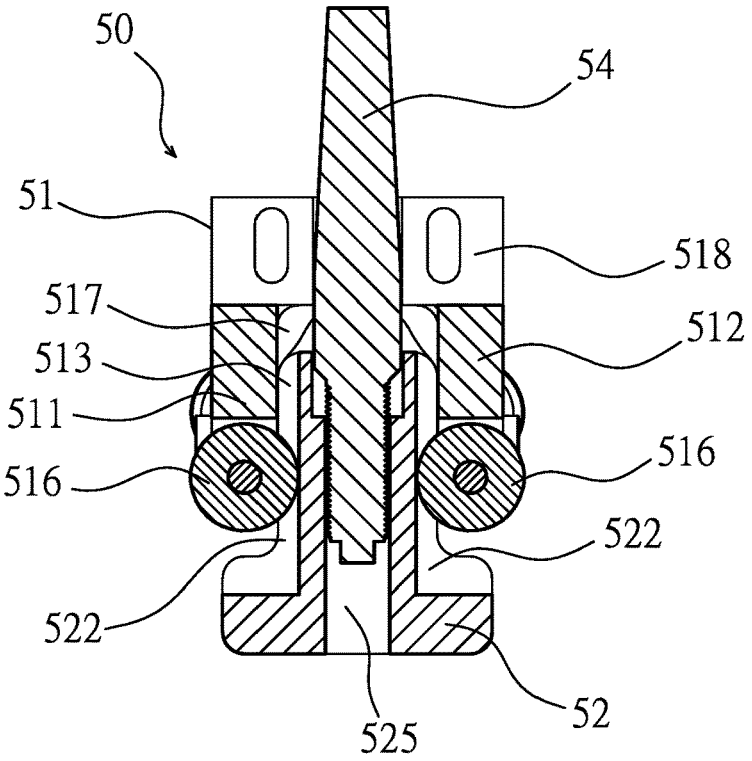
FIG. 8 is a sectional view showing the assembly of the guide rollers and the vertical grooves of the card dispensing device of the present invention.
Figure 9:
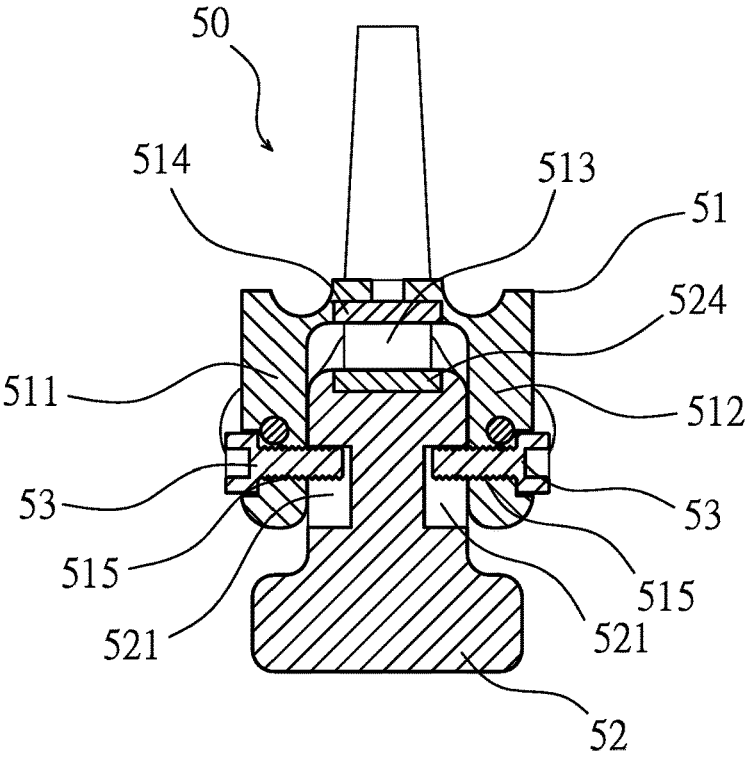
FIG. 9 is a sectional view showing the assembly of the slots and the screws of the card dispensing device of the present invention.
Figure 10:
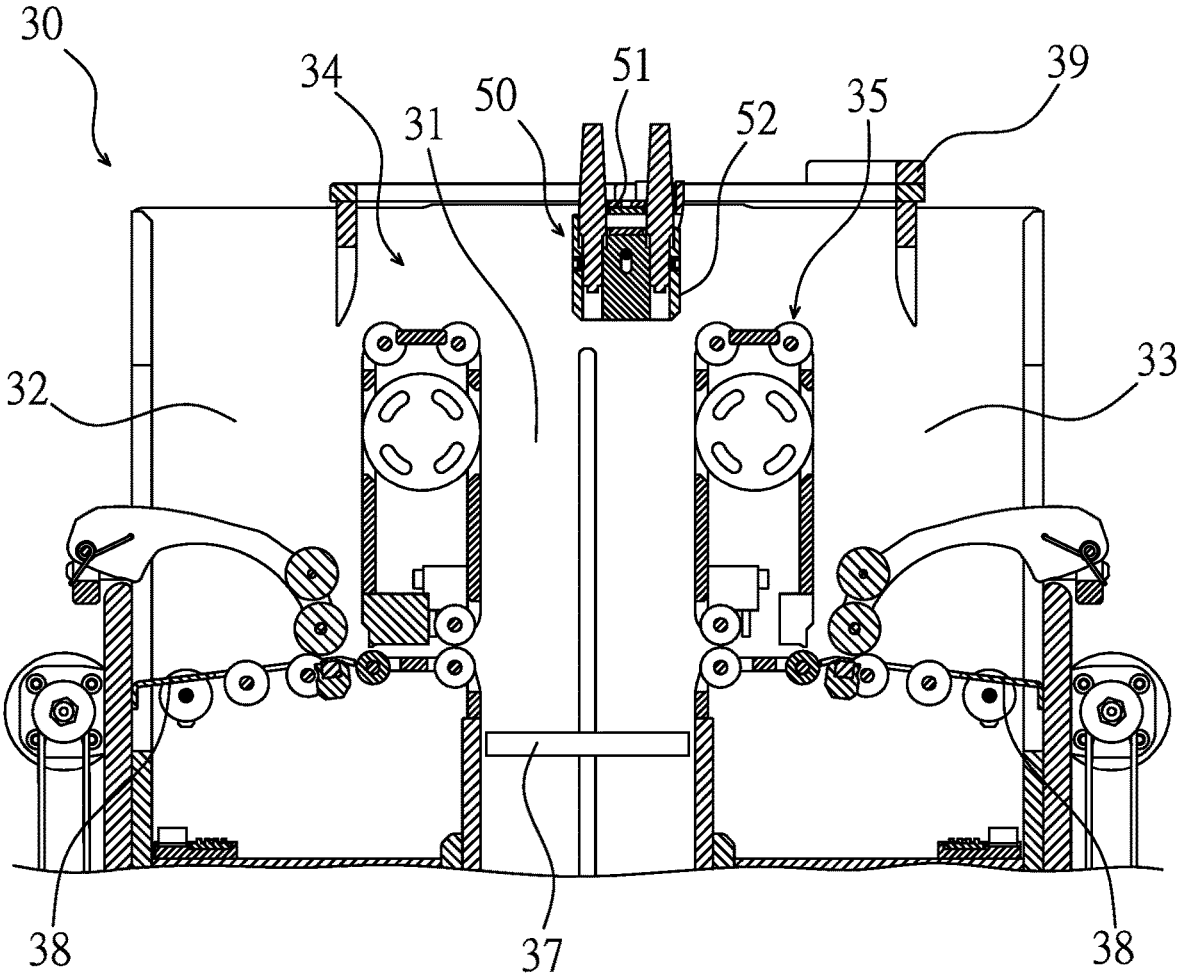
FIG. 10 is a front sectional view of the present invention.

Embodiments of the present invention will now be described, by way of example only, with reference to the accompanying drawings.

Referring to FIG. 5 through FIG. 17, the present invention discloses a shuffling machine 30 having a card dispensing structure. The shuffling machine 30 has a central accommodating compartment 31, a left accommodating compartment 32, and a right accommodating compartment 33. A card dispensing space 34 is disposed above the central accommodating compartment 31, the left accommodating compartment 32 and the right accommodating compartment 33. Either side of the top end of the central accommodating compartment 31 is provided with a card guiding roller assembly 35 which can be rotated clockwise and counterclockwise. The central accommodating compartment 31 is provided with a central lifting platform 37. A lifting platform 38 is disposed in each of the left accommodating compartment 32 and the right accommodating compartment 33. A translation plate 39 is moveably disposed at a predetermined height above the central accommodating compartment 31, the left accommodating compartment 32, and the right accommodating compartment 33. A driving mechanism 40 is connected to the translation plate 39 for driving the translation plate 39 to move back and forth in the left and right directions of the card dispensing space 34. The driving mechanism 40 includes a left sensor 41, a fixed-point sensor 42 and a right sensor 43. The rear end of the translation plate 39 is provided with a horizontal rod 44 and a rear protruding portion 45. The distance between two ends of the horizontal rod 44 is greater than the distance between two ends of the rear protruding portion 45. One end of the horizontal rod 44 is provided with a left sensing terminal 46, and another end of the horizontal rod 44 is provided with a right sensing terminal 47. A left sensing member 48 is disposed on one end of the rear protruding portion 45, and a right sensing member 49 is disposed one another end of the rear protruding portion 45. The translation plate 39 is provided with a card dispensing device 50 extending downwardly. The card dispensing device 50 is configured to dispense playing cards 1 in the card dispensing space 34. The card dispensing device 50 includes a fixed seat 51 that is fixed to the translation plate 39 and a dispensing block 52 that is movably connected to the fixed seat 51. The fixed seat 51 has a reverse "U" shape, and includes a front plate 511, a rear plate 512 and a recessed portion 513 between the front plate 511 and the rear plate 512. An upper magnetic member 514 is disposed on the top surface of the recessed portion 513. A screw hole 515 is defined in each of the front plate 511 and the rear plate 512. Two sides of the front plate 511 and the rear plate 512 are provided with guide rollers 516, respectively. The top of the fixed seat 51 is formed with holes 517 and a coupling groove 518. The translation plate 39 is connected to the coupling groove 518 of the fixed seat 51. The front and rear sides of the dispensing block 52 are formed with slots 521 corresponding to the screw holes 515 of the front plate 511 and the rear plate 512. Two sides of each slot 521 are provided with a pair of vertical grooves 522 corresponding to the guide rollers 516. The left and right sides of the underside of the dispensing block 52 have beveled edges 523. The top of the dispensing block 52 is provided with a lower magnetic member 524 and two perforations 525. The lower magnetic member 524 and the upper magnetic member 514 are arranged with their like poles to repel each other. The dispensing block 52 is insertedly connected to the recessed portion 513 of the fixed seat 51, the guide rollers 516 are slidably connected to the vertical grooves 522, and two screws 53 are inserted through the screw holes 515 and engaged in the slots 521. Two fiber optic sensors 54 pass through the fixed seat 51 or are inserted through the holes 517 of the top of the fixed seat 51 to be connected to the perforations 525. The upper magnetic member 514 and the lower magnetic member 524 are repulsive, so that the fixed seat 51 is able to repel the dispensing block 52 downward, and the dispensing block 52 can be displaced up and down through the slots 521. The driving mechanism 40 can drive the translation plate 39 further to drive the card dispensing device 50 to move back and forth in the left and right directions of the shuffling machine. The fixed-point sensor 42 is configured to sense the left sensing terminal 46 and the right sensing terminal 47, so that the translation plate 39 has a first displacement stroke, and each fiber optic sensor 54 can detect whether there is a playing card 1 between each card guiding roller assembly 35 and the dispensing block 52. The left sensor 41 is configured to sense the left sensing member 48, and the right sensor 43 is configured to sense the right sensing member 49, so that the translation plate 39 has a second displacement stroke, and the dispensing block 52 in the card dispensing space 34 is configured to dispense the playing cards 1 located in the central accommodating compartment 31 to the left accommodating compartment 32 or the right accommodating compartment 33. When the card dispensing device 50 dispense the playing card 1 from the central accommodating compartment 31 to the left accommodating compartment 32 or the right accommodating compartment 33, if the corner of the playing card 1 is warped or arched by the dispensing block 52 mistakenly, the beveled edge 523 of the dispensing block 52 allows the dispensing block 52 to rise from the edge of the playing card 1 to dispense the playing card smoothly, thereby avoiding the playing card 1 from being deformed and damaged. When the translation plate 39 is in the first displacement stroke, if the playing card 1 that is erroneously attracted is stuck between the dispensing block 52 and the card guiding roller assembly 35, the fiber optic sensor 54 senses and rotates the card guiding roller assembly 35 in the reverse direction, and the playing card 1 is returned to the central accommodating compartment 31 to remove obstacles, thereby preventing the game from being unfair.

Figure 11:
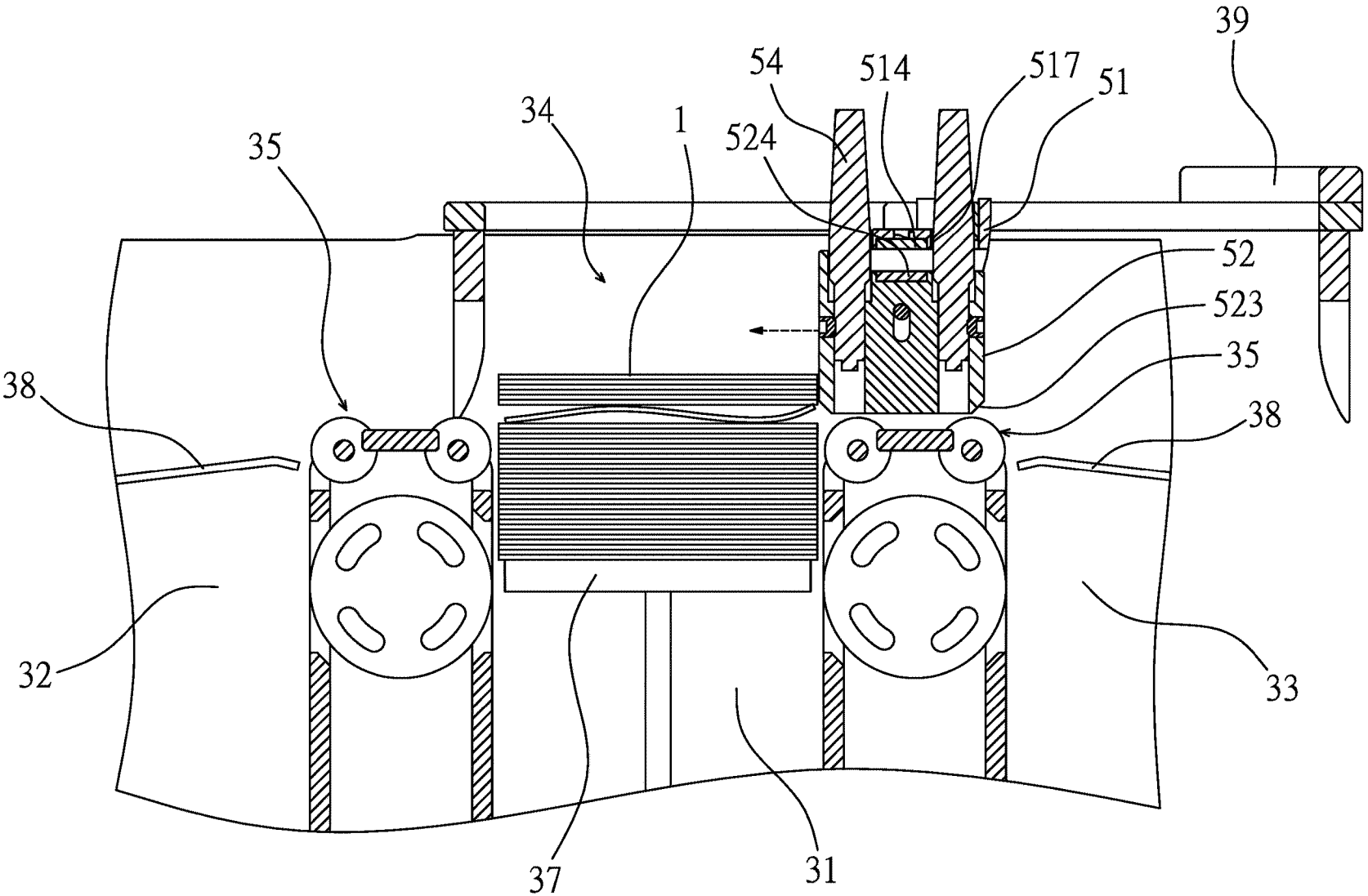
FIG. 11 is a sectional view showing that the card dispensing device of the present invention is moved from right to left.
Figure 12:
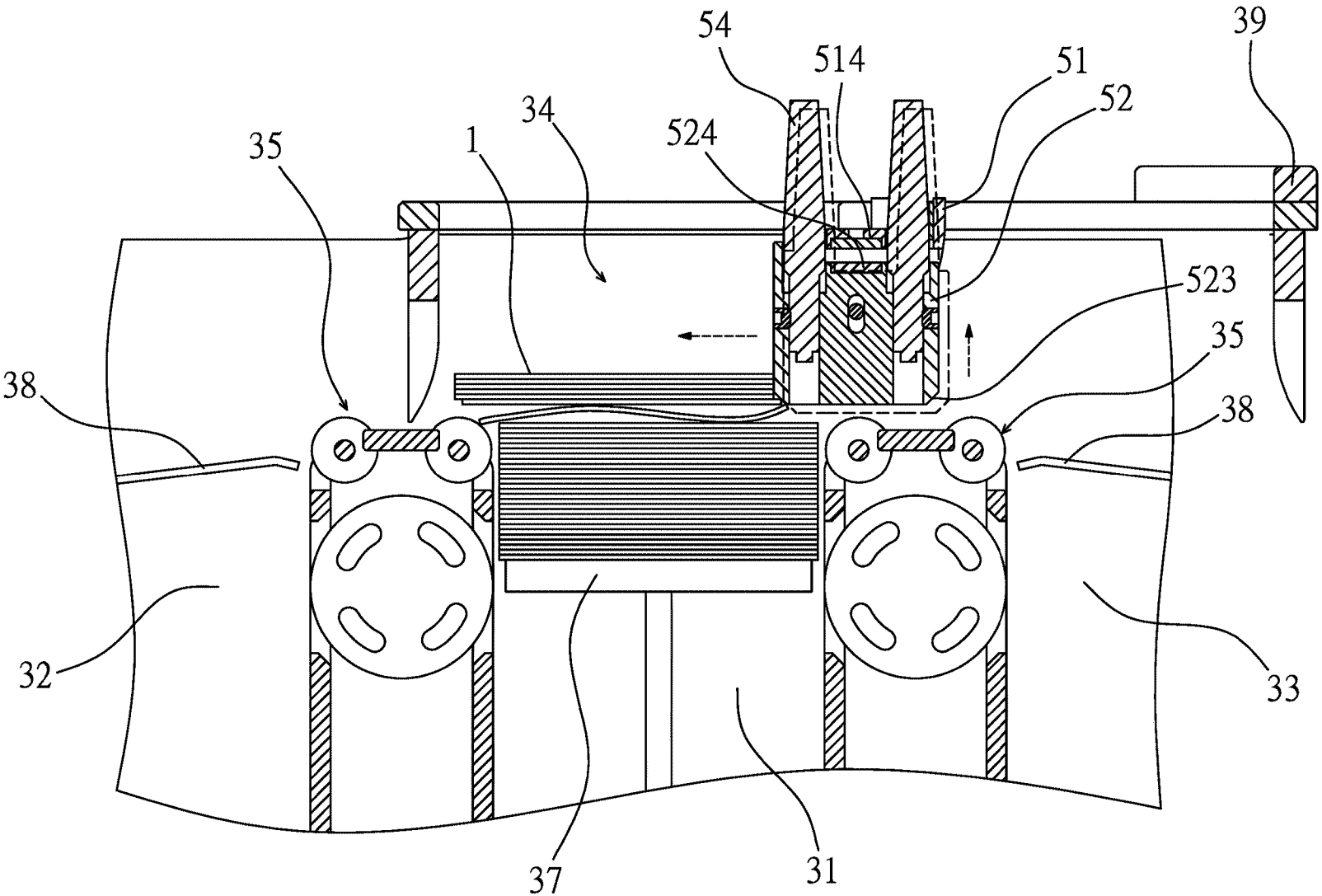
FIG. 12 is a sectional view showing that one playing card is mistakenly riffled upward by the card dispensing device of the present invention.
Figure 13:
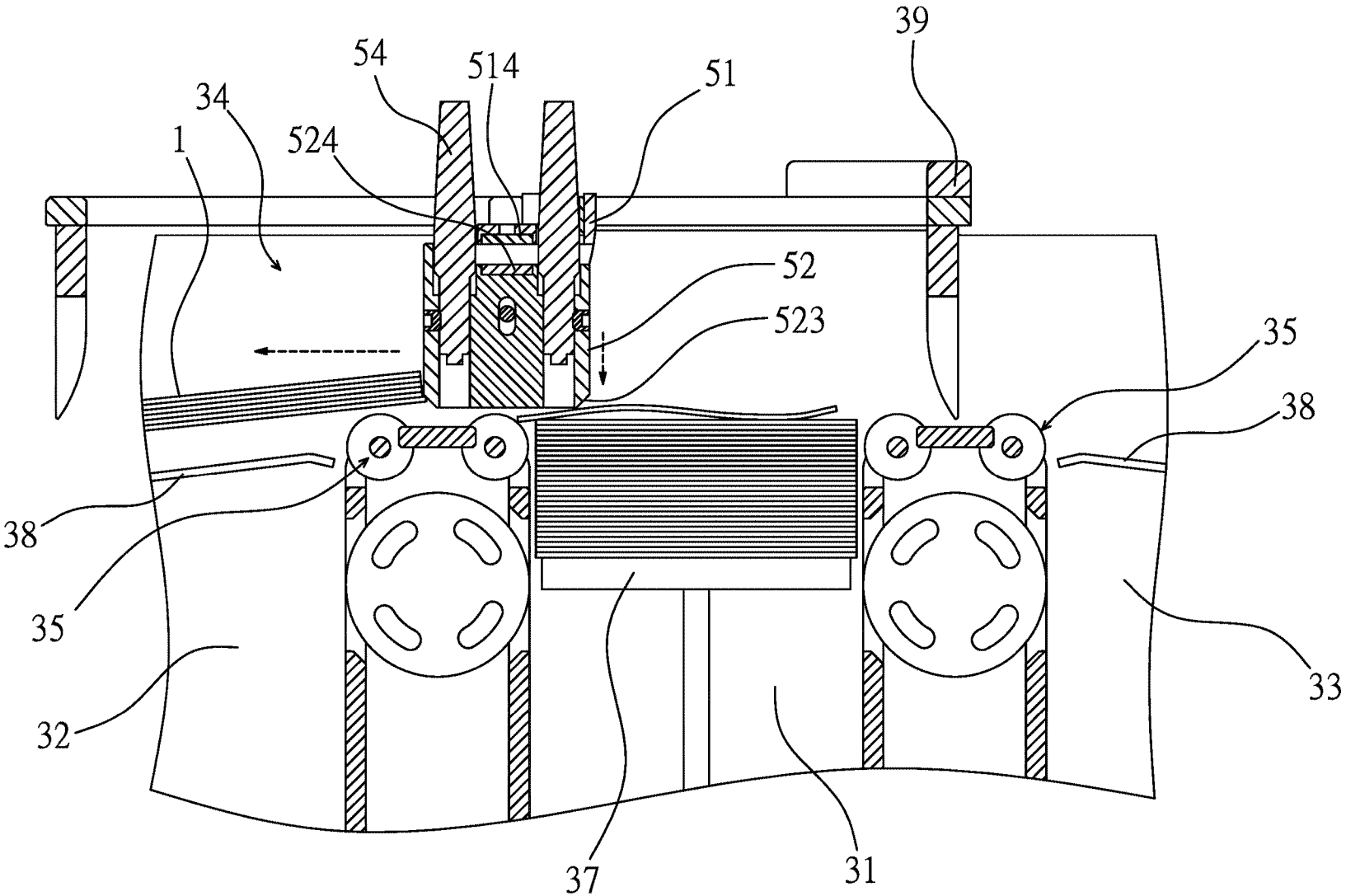
FIG. 13 is a sectional view showing that the card dispensing device is in the first displacement stroke of the present invention.
Figure 14:
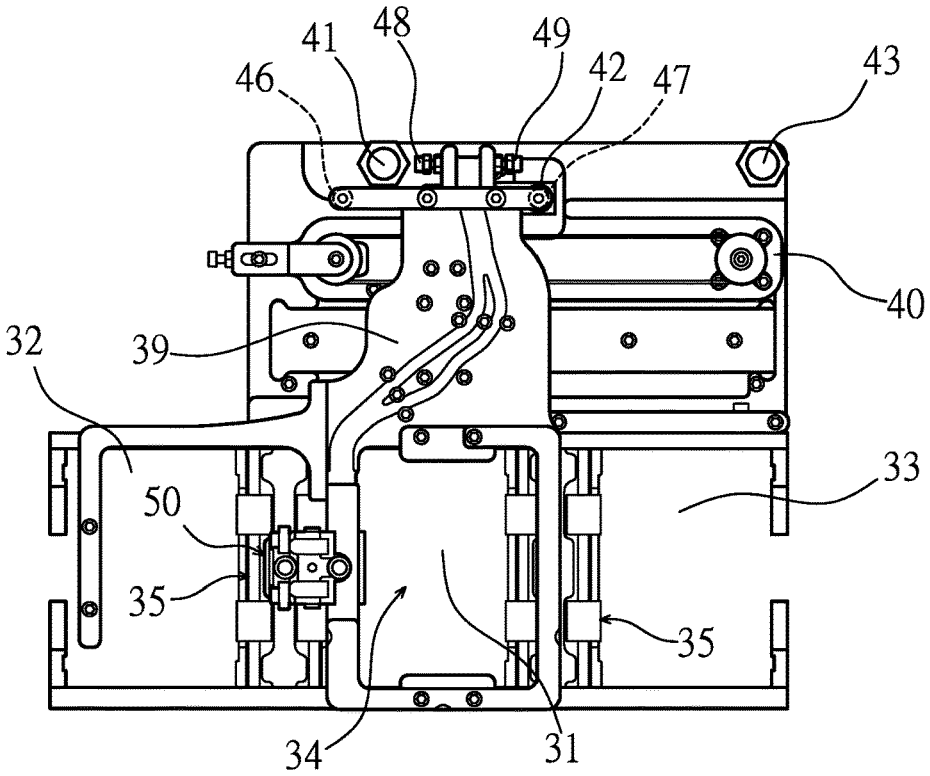
FIG. 14 is a top view showing that the translation plate is moved leftward in the first displacement stroke of the present invention.
Figure 15:
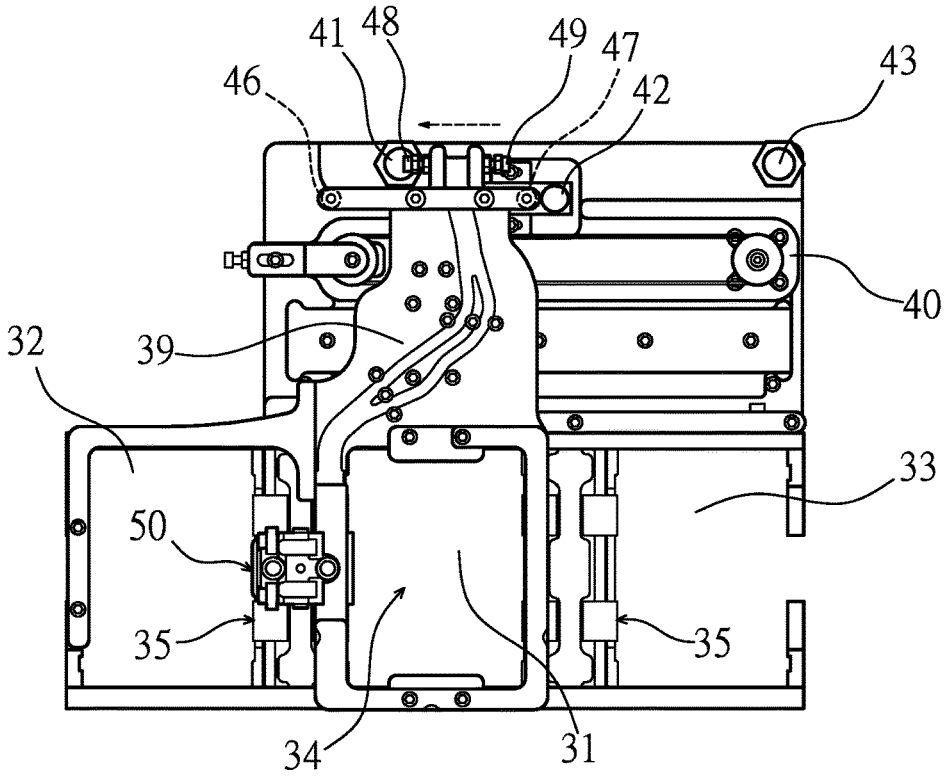
FIG. 15 is a top view showing that the translation plate is moved leftward in the second displacement stroke of the present invention.
Figure 16:
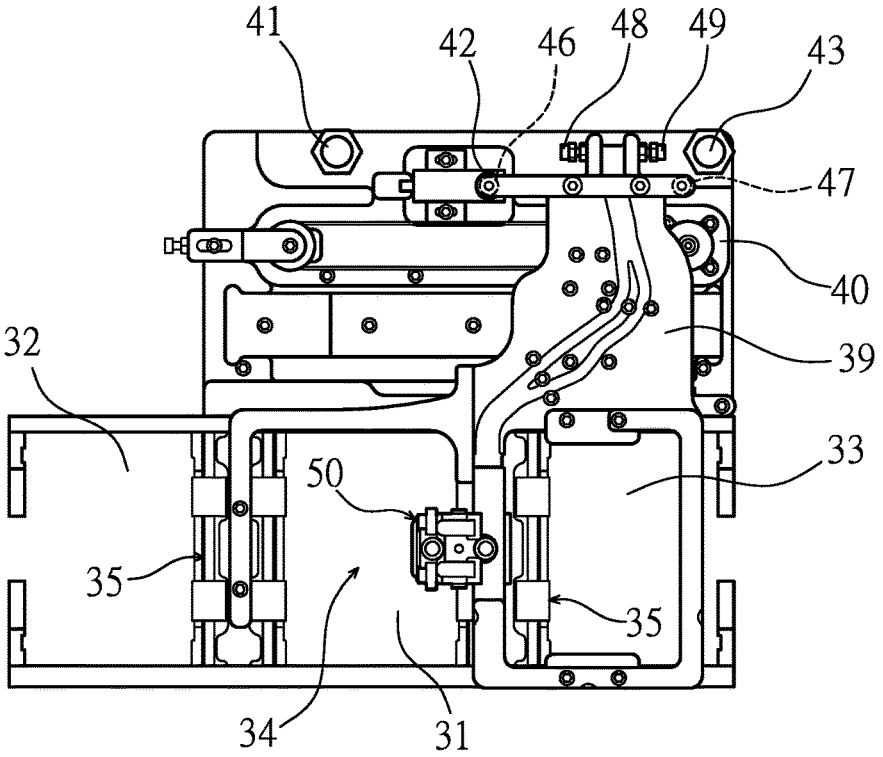
FIG. 16 is a top view showing that the translation plate is moved rightward in the first displacement stroke of the present invention.
Figure 17:
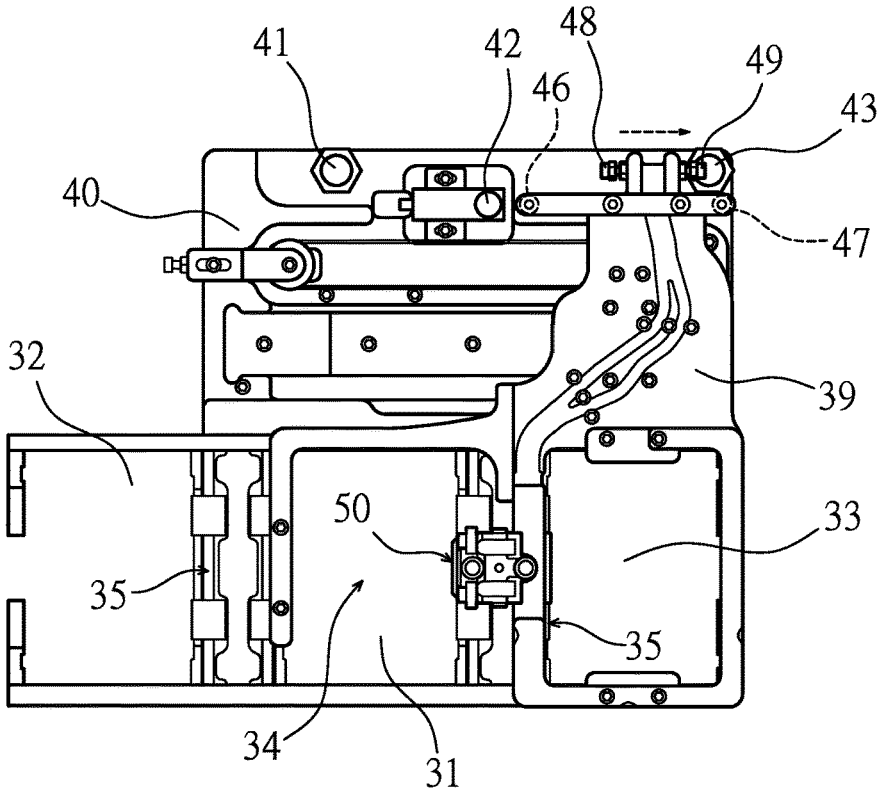
FIG. 17 is a top view showing that the translation plate is moved rightward in the second displacement stroke of the present invention.

The assembly, function and details of the present invention are described below. Referring to FIGS. 5 to 17, the invention is electrically connected to a control device (not shown), and the control device may be a circuit board or a computer, but not limited thereto. The left sensor 41, the fixed-point sensor 42 and the right sensor 43 of the driving device 40 may be proximity switches. The left sensing terminal 46, the right sensing terminal 47, the left sensing member 48 and the right sensing member 49 may be made of metal, which is beneficial for the left sensor 41, the fixed-point sensor 42 and the right sensor 43 to sense and send a signal to the control device, but not limited thereto. The magnetic member 514 and the lower magnetic member 524 of the card dispensing device 50 may be magnets, and the poles of the two are arranged in the form of N-S, S-N or S-N, N-S from the top to the bottom, with like poles to repel each other, so that the fixed seat 51 is able to repel the dispensing block 52 downward. The fixed seat 51 of the card dispensing device 50 is fixed to the translation plate 39. The dispensing block 52 can be moved up and down with the vertical grooves 522 to slide on the guide rollers 516 of the fixed seat 51. In this way, when the dispensing block 52 dispenses the playing cards, the two sides of the dispensing block 52 are in a vertical direction, so that the dispensing block 52 won't shake along with the movement of the translation plate 39. The slots 521 of the dispensing block 52 are adapted for the upper and lower limits when the screws 53 slide along the slots 521, and also prevent left and right shaking. When a shuffle is desired, all the playing cards 1 are placed on the central lifting platform 37 in the central accommodating compartment 31, and the central lifting platform 37 is gradually lifted to bring the playing cards 1 into the card dispensing space 34. The driving mechanism 40 drives the translation plate 39 to move left and right. If the playing card is to be dispensed to the left accommodating compartment 32, the translation plate 39 is driven to dispense the playing card 1 located in the card dispensing space 34 from right to left. The dispensing block 52 of the card dispensing device 50 has the upper and lower magnetic members 514, 524 to repel each other and pushes the right side of the playing card 1 (as shown in FIG. 11). The side and the beveled edge 523 of the dispensing block 52 simultaneously push the playing card 1 toward the left accommodating compartment 32. During the displacement of dispensing playing cards, a playing card 1 which is warped or arched due to long-term use may be mistakenly riffled by the beveled edge 523 of the dispensing block 52. Since the playing card 1 that is mistakenly riffled may have a high point at its end edge, the high point is usually mistakenly riffled by the beveled edge 523 of the dispensing block 52, and the other end of the playing card 1 is bent at an angle (bent downward) and blocked by the card guiding roller assembly 35. However, at this time, the dispensing block 52 does not stop dispensing the playing card. When the dispensing block 52 continues to move, the playing card 1 held between the beveled edge 523 of the dispensing block 52 and the card guiding roller assembly35 generate a greater blocking force on the dispensing block 52. The beveled edge 523 of the dispensing block 52 causes the edge of the playing card 1 to be guided along the slope of the beveled edge 523 to slide downward. At the same time, the dispensing block 52 generates a reaction force against the repulsive magnetic force of the upper magnetic member 514 and the lower magnetic member 524 to be lifted (as shown in FIG. 12). In turn, the playing card 1 is separated from the edge of the dispensing block 52 by the beveled edge 523 and falls back to the central accommodating compartment 31, so that the playing card 1 is not bent to avoid damage. After the playing card 1 that is mistakenly riffled falls back to the central accommodating compartment 31, the bottom end of the dispensing block 52 is unobstructed, and the repulsive magnetic force of the upper magnetic member 514 and the lower magnetic member 524 allows the dispensing block 52 to descend to the original height. After that, the translation plate 39 continues to dispense the playing card leftward, and the playing card 1 pass the card guiding roller assemb1y35. When the right sensing terminal 47 of the translation plate 39 is moved to be above the fixed-point sensor 42 (as shown in FIG. 14), the fixed-point sensor 42 can sense and send a signal to the control device, and the driving mechanism 40 temporarily stops driving the translation plate 39. This is the first displacement stroke for dispensing the playing cards leftward. At this time, the fiber optic sensor 54 of the card dispensing device 50 corresponds to the position of the card guiding roller assemb1y35 (as shown in FIG. 13), and the control device simultaneously command the fiber optic sensor 54 to sense whether there is a playing card 1 between the card guiding roller assembly 35 and the card dispensing device 50. This situation is usually caused by improper adsorption of the playing card 1. The fiber optic sensor 54 of the present invention is a short-distance sensor that only senses the playing card 1 located between the card guiding roller assembly 35 and the card dispensing device 50. If there is a playing card 1 located between the card guiding roller assembly 35 and the card dispensing device 50, the control device commands the card guiding roller assembly 35 to rotate reversely toward the central accommodating compartment 31 for a set time, so that the playing card 1 that is not moved correctly is returned to the central accommodating compartment 31. Then, the dispensing block 52 continues to dispense the playing cards 1. When the left sensing member 48 of the translation plate 39 is moved to be above the left sensor 41 (as shown in FIG. 15), the left sensor 41 can sense and send a signal to the control device to command the driving mechanism 40 to stop driving the translation plate 39. This is the second displacement stroke for dispensing the playing card leftward. At this time, the playing card 1 are correctly moved to the lifting platform 38 of the left accommodating compartment 32, and the leftward dispensing is completed. Of course, if the fiber optic sensor 54 of the card dispensing device 50 detects there is no playing card 1 that is not correctly dispensed during the first and second displacement strokes, it is not necessary to rotate the card guiding roller assembly 35 reversely. On the contrary, the central lifting platform 37 is lifted again to bring the playing card 1 into the card dispensing space 34, and the translation plate 39 is driven to dispense the playing card 1 located in the card dispensing space 34 from left to right. When the left sensing terminal 46 of the translation plate 39 is moved to be above the fixed-point sensor 42 (as shown in FIG. 16), the driving mechanism 40 temporarily stops driving the translation plate 39. This is the first displacement stroke for dispensing the playing card rightward. At this time, the fiber optic sensor 54 of the card dispensing device 50 senses whether there is a playing card 1 between the card guiding roller assembly 35 and the card dispensing device 50. Then, the dispensing block 52 continues to dispense the playing card 1. When the right sensing member 49 of the translation plate 39 is moved to be above the right sensor 43 (as shown in FIG. 17), the driving mechanism 40 stops driving the translation plate 39. This is the second displacement stroke for dispensing the playing card rightward, and the rightward dispensing is completed. The operation is repeated until there is no playing card 1 on the central lifting platform 37, that is, all the playing cards are dispensed completely.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A shuffling machine having a card dispensing structure, the shuffling machine having a central accommodating compartment, a left accommodating compartment and a right accommodating compartment for accommodating playing cards, a card dispensing space being disposed above the central accommodating compartment, the left accommodating compartment and the right accommodating compartment, either side of a top end of the central accommodating compartment being provided with a card guiding roller assembly; a translation plate being moveably disposed in the card dispensing space, a driving mechanism being connected to the translation plate; the translation plate being coupled with a card dispensing device configured to dispense the playing cards in the card dispensing space, the card dispensing device including a fixed seat that is fixed to the translation plate and a dispensing block that is movably connected to the fixed seat; the fixed seat having a reverse "U" shape and including a front plate, a rear plate and a recessed portion between the front plate and the rear plate, an upper magnetic member being disposed on a top surface of the recessed portion, a top of the dispensing block being provided with a lower magnetic member corresponding to the upper magnetic member, the upper magnetic member and the lower magnetic member being arranged with their like poles to repel each other, the dispensing block being insertedly connected to the recessed portion of the fixed seat, the fixed seat being able to repel the dispensing block downward, the fixed seat limiting a vertical displacement of the dispensing block within a predetermined distance, left and right sides of an underside of the dispensing block having beveled edges.

2. The shuffling machine as claimed in claim 1, wherein the fixed seat is provided with at least two guide rollers that are coaxial and corresponds to each other radially, and the dispensing block is provided with at least two vertical grooves corresponding in position to the guide rollers so that the dispensing block is assembled to the fixed seat with the vertical grooves to lean against the guide rollers.

3. The shuffling machine as claimed in claim 2, wherein a screw hole is defined in each of the front plate and the rear plate, the guide rollers are connected to respective sides of the front plate and the rear plate; a top of the fixed seat is formed with a coupling groove for connecting the translation plate, front and rear sides of the dispensing block are formed with vertical slots corresponding to the screw holes of the front plate and the rear plate, and two screws are inserted through the screw holes and engaged in the slots.

* * * * *